United States Patent [19]

Cozzolino

[11] 4,305,457

[45] Dec. 15, 1981

[54] HIGH DENSITY FIN MATERIAL

[75] Inventor: Henry Cozzolino, Dayton, Ohio

[73] Assignee: United Aircraft Products, Inc., Dayton, Ohio

[21] Appl. No.: 67,678

[22] Filed: Aug. 20, 1979

[51] Int. Cl.[3] ..... F28D 7/10

[52] U.S. Cl. ..... 165/154

[58] Field of Search ..... 165/154, 155, 179, 183, 165/184; 138/38, 112, 113, 114

[56] References Cited

U.S. PATENT DOCUMENTS 2,362,571 11/1944 McCollum ..... 165/179
3,474,513 10/1969 Allingham ..... 165/154
3,831,247 8/1974 Degroote ..... 165/154 X

FOREIGN PATENT DOCUMENTS 845574 8/1960 United Kingdom ..... 165/179
282355 12/1970 U.S.S.R. ..... 138/38

*Primary Examiner*—Sheldon J. Richter
*Attorney, Agent, or Firm*—J. E. Beringer

[57] ABSTRACT

A fin strip of the kind used as secondary heat transfer surface in heat exchangers. Convolutions in the strip are formed to increase the developed length of a fin strip and thereby to increase the surface area which can be accommodated in a given space, particularly an annular space, without obstruction to flow. In a strip corrugated to provide alternating peaks and valleys, peaks are depressed to form spaced apart peak portions interconnected by intermediately positioning valley portions which add to the developed length of the strip without reducing the space between strip valleys. In an annular space occupied by a fin strip made in accordance with the invention fin density is substantially uniform throughout.

2 Claims, 5 Drawing Figures

HIGH DENSITY FIN MATERIAL

BACKGROUND OF THE INVENTION

This invention relates to fin strip material, particularly, although not exclusively, as used in heat exchange tubes as a secondary heat transfer material. Heat transfer capabilities tend to be affected by the amount of secondary surface area made available in a given flow passage. However, fin density cannot be increased without regard to the extent to which the pressure drop of a flowing fluid may be affected. Also, and especially in dealing with a fin strip which must be bent to an annular configuration for installing between concentric tubes, adjacent fins crowd upon one another along the inner periphery of a curved strip and consequently reduce open flow area. In light of these considerations, it is the practice in the prior art to select a fin strip which, in terms of fins per inch, is essentially a compromise between what the designer would like to achieve in heat transfer performance and what is possible to achieve while maintaining an acceptable volume of flow over the fin surface. It has been suggested that the problem of crowding along the inner periphery of a bent strip can be overcome by forming the fin convolution so that valley portions are more widely spaced apart than are peak portions. See DeGroote U.S. Pat. No. 3,831,247, dated Aug. 27, 1974. This lessens flow and pressure drop problems but does so at a cost in overall fin density. Neither does it provide substantially uniform fin density with substantially uniform open flow area between fin surfaces. Insofar as is known, the problem of achieving high and uniform fin density without seriously affecting volume flow and pressure drop has not heretofore been successfully dealt with.

SUMMARY OF THE INVENTION

In accordance with the present invention, a fin strip is made of a ductile material having good heat transfer properties, crimped or otherwise configured to a corrugated shape in which peaks and valleys alternate with one another along the strip length. Each peak is indented to form in each fin convolution a pair of spaced apart peak portions and the indentation forms a valley portion relatively more shallow than adjacent valleys. The arrangement provides for a developed length of fin strip which is greater than that provided by what may be regarded as standard fin strip material, and consequently increased surface area in a given flow space. Corrugation valleys are inherently spaced apart a distance to obviate crowding along the inner periphery of a curved strip, and the depth of the indented valley portion is such as to provide for substantially uniform open flow area between presented fin surfaces. As inserted in an annular space, in a concentric tube assembly or the like, the strip is bent in a direction to place peak portions thereof in contact with an outer defined wall and valley portions in contact with an inner defined wall, fin spacing at inner and outer walls being substantially the same.

An object of the invention is to provide high density fin material substantially as set forth in the foregoing.

Other objects and structural details of the invention will more clearly appear from the following description, when read in connection with the accompanying drawings, wherein.

Figure 1:
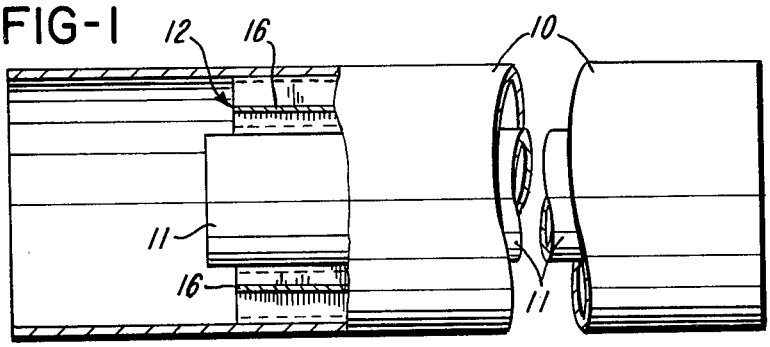
FIG. 1 is a view in side elevation of a tube assembly embodying fin material in accordance with the illustrated embodiment of the invention.

Referring to the drawings, a tube assembly which may provide a place of use for a fin material in accordance with the invention, comprises an outer tube 10 made of a metal of good thermal conductivity. The tube 10 is of a uniform diameter, is relatively thin walled and is open at both ends. There may be comprised in the tube assembly an inner tube 11 which may be constructed like the tube 10 but which in any event provides with the outer tube an annular space to be occupied by a configured strip 12 providing secondary heat transfer surface. The strip 12 is comprised of a thin gauge, ductile metal of good thermal conductivity. Originally in a sheet or ribbon-like form, it is gathered and crimped to a corrugated formation to define a series of parallel fin convolutions of longitudinal extent.

The configuration of the strip 12 will be considered in greater detail hereinafter. A configured strip is bent to an annular configuration about the inner tube 11, with these parts then being inserted as a sub-assembly into outer tube 10. With the parts so positioned, the strip 12 has an outer surface presented for contact with the inner wall of tube 10 and an inner surface presented for contact with the exterior of inner tube 11. The parts will preferably have a friction fit in which they are yieldingly held in an assembled relation. If found necessary or desirable to achieve a more uniformly contacting relation of the fin material to the outer tube wall, the inner tube 11 may be expanded, as by passing a mandrel therethrough. It is in any event contemplated that peak portions of the fin strip as presented for contact with the interior wall of tube 10 will closely and intimately contact the tube wall, providing for a minimum of contact resistance in a transfer of thermal energy between the tube wall and the fin material.

Installations using a formed tube assembly may include one in which a plurality of formed tubes is disposed in a bundle for flow of a first fluid over and around the tube exteriors. A second fluid, in separated relation to the first, is controlled and directed to pass longitudinally through the tubes, that is, in each instance, through an annular space occupied by the fin strips 12. The flowing fluid is in contact with the inner wall of tube 10 and is also in contact with the material of fin strip 12. Assuming the first and second fluids to be of different temperature, a transfer of heat takes place through the tube wall. The tube wall serves as primary heat transfer surface with respect to the second fluid in contact therewith. The material of fin strip 12 acts as a secondary surface, conducting heat to or from the tube wall.

Figure 2:
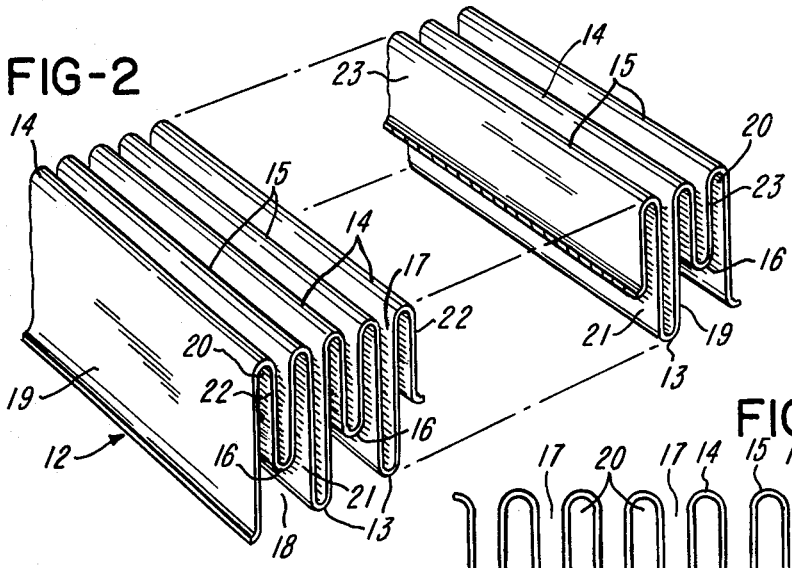
FIG. 2 is a view in perspective of fin material in accordance with the illustrated embodiment of the invention.
Figure 3:
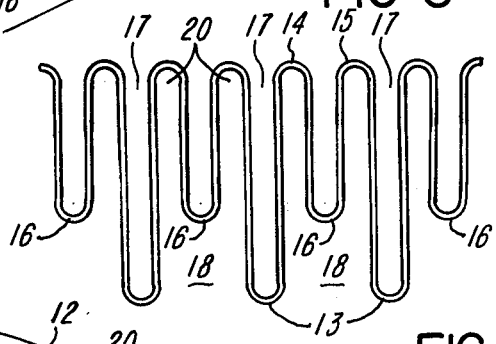
FIG. 3 is a detail end view of a fin strip as in FIG. 2, prior to being bent for installation in a tube.
Figure 5:
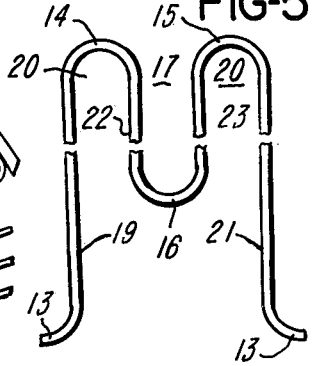
FIG. 5 is an enlarged, detail view of the fin strip, showing one convolution thereof.

In accordance with concepts of the present invention, the fin strip 12 has a configuration substantially to increase the amount of secondary surface area provided in the annular space between tubes 10 and 11 without so reducing the amount of open flow area as adversely to affect the flow and pressure drop of a fluid flowing through the described annular space. As seen in FIGS. 2 and 3, in deforming a ribbon-like sheet, to achieve the fin strip 12, there is produced multiple, connected convolutions, an individual one of which is shown in FIG. 5. Each convolution comprises laterally spaced apart valleys 13 and an intermediately positioning peak which according to present invention concepts comprises a pair of peak portions 14 and 15. Peak portions 14 and 15 are connected by a valley portion 16, the peak of the convolution being thus depressed to form the spaced apart peak portions 14–15 and the interconnecting valley portion 16. Valley portion 16 is relatively more shallow than valleys 13, extending to a point intermediate the crests of oppositely facing peaks and valleys. The strip 12 may be regarded as having upper and lower surfaces, the former occupied and defined by the peak portions 14 and 15 and the latter being defined by valleys 13. Valley portion 16 extends to a location intermediate spaced apart planes as represented by upper and lower strip surfaces.

Figure 4:
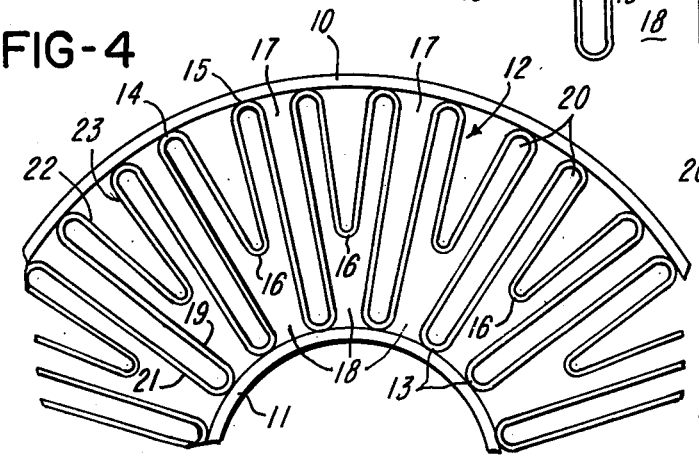
FIG. 4 is a relatively enlarged and fragmentary view of a tube, showing fin material in place therein.

In forming the fin strip 12 about the tube 11, or in otherwise arcuately shaping the strip for installation in a heat transfer duct, the strip is bent about an axis substantially parallel to the long dimensions of the fin convolutions, with the previously defined upper side or surface of the fin strip forming the periphery of larger radius and the described lower side or surface of the strip forming the periphery of smaller radius. Spaces 17 accordingly open through the outer periphery of the formed strip between adjacent convolutions and to either side of each pair of peak portions 14 and 15. At the same time, spaces 18 open through the inner periphery of the strip between each adjacent pair of valleys 13 and spaces 20 appear to either side of valley portion 16. In the forming process, as seen in FIG. 4, adjacent valleys 13 tend to move more closely together while peak portions of each convolution and the peaks of adjacent convolutions tend to separate. Corresponding adjustments in the area of the spaces 17 and 18 result, with these spaces maintaining, however, their individual identities. In the absence of specially configured fin strip material, a rolled or curved fin strip will find valley portions thereof forced together in a manner materially to restrict flow through the fin annulus with consequent adverse effect upon heat transfer efficiency. In the present instance, and as shown in FIG. 2, both sets of flow passages as represented by spaces 17 and 18 remain open in the installed position of the fin material, permitting the fin assembly to function in proper accord with its design specifications. Further, since each peak of the fin strip is divided into separated peak portions and interconnected by a depressed valley portion, the total amount of surface area presented by the fin strip in its installed position is increased. Thus, and again referring to FIG. 5, each fin convolution includes fins 19 and 21 interconnecting upper and lower surfaces of the fin strip and additionally includes fins 22 and 23 interconnecting peak portions 14-15 and valley portion 16. The fins 22-23 and their interconnecting valley portion 16 accordingly represent added surface area which may be contacted by the flowing fluid with increased benefit in the rate and facility with which heat may be transferred into or out of the wall of tube 10. Still further, fin density, as measured in terms of fins per inch, tends to be substantially uniform throughout the annular space occupied by the bent fin. The open areas of each fin convolution are substantially the same and fin surface area is substantially uniformly contacted by fluid flowing between the tubes 10 and 11.

The fin strip is configured using appropriate forming apparatus in which ribbon-like sheet material is fed between opposing, reciprocable dies which form the successive convolutions of FIG. 5. Machinery for forming the convolutions does not form a part of the present invention and so will not additionally be commented upon. The peaks and valleys of the convolution are in the illustrated instance made arcuate in form. Obviously, however, the fin crests may be squared off or be made more sharply angular, as may be desired. Also, in accordance with the desired degree of density of secondary surface material, the fin convolutions may be formed in differential number per strip inch. This will result in adjacent convolutions being more widely spaced apart or in peak portions 14 and 15 being more widely spaced apart, or both. In either event, the result is more open flow area as represented by the outwardly and inwardly opening spaces 17 and 18.

The invention has been disclosed with reference to a particular structural embodiment. Modifications have been discussed and these and others obvious to a person skilled in the art to which the invention relates are considered to be within the intent and scope of the invention.

What is claimed is:

1. A heat transfer tube providing an annular space reclining a strip of a relatively flexible and ductile fin material, deformed into a corrugated configuration in which alternating peaks and valleys terminate in respective spaced apart planes defining upper and lower strip faces and are interconnected by fins extending substantially from plane to plane, the strip presenting repeated convolutions and the peaks of at least certain convolutions being depressed to include intermediately of peak portions a valley portion locating between said planes and interconnected to said peak portions by respective fin portions, opposite faces of said strip contacting respective inner and outer tube walls defining said annular space, said strip being bent in a direction to place an upper face of said strip comprised of said peak portions in contact with an outer one of said tube walls.

2. A heat transfer duct providing an arcuate space receiving a strip of relatively flexible and ductile fin material, deformed into a corrugated configuration in which alternating peaks and valleys terminate in respective spaced apart planes defining upper and lower strip faces for respective contact with outer and inner walls of said duct defining said annular space, said peaks and valleys being interconnected by fins extending substantially from plane to plane, the strip presenting repeated convolutions and the peaks of at least certain convolutions being depressed to include intermediately of peak portions a valley portion locating between said planes and interconnected to said peak portions by respective fin portions, the depth of said valley portions being such as to provide for substantially uniform open flow area through said strip as flexed in the arcuate space of said duct, said strip being bent in a direction to place an upper face of said strip comprised of said peak portions in contact with an outer one of said duct walls.

* * * * *

UNITED STATES PATENT OFFICE

CERTIFICATE OF CORRECTION

PATENT NO. : 4,305,457

DATED : December 15, 1981

INVENTOR(S) : Henry Cozzolino

It is certified that error appears in the above-identified patent and that said Letters Patent are hereby corrected as shown below:

Column 4, line 31, "reclining" should read --receiving--.

Signed and Sealed this

*Twenty-third* Day of *February 1982*

[SEAL]

*Attest:*

GERALD J. MOSSINGHOFF

*Attesting Officer*

*Commissioner of Patents and Trademarks*